US009846376B2

(12) United States Patent
Nakamura

(10) Patent No.: US 9,846,376 B2
(45) Date of Patent: Dec. 19, 2017

(54) SPRAY GUN FOR COATING, SPRAY COATING DEVICE, AND METHOD FOR PRODUCING ELECTROPHOTOGRAPHIC PHOTOCONDUCTOR

(71) Applicant: Akira Nakamura, Shizuoka (JP)

(72) Inventor: Akira Nakamura, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 606 days.

(21) Appl. No.: 14/484,347

(22) Filed: Sep. 12, 2014

(65) Prior Publication Data

US 2015/0079275 A1 Mar. 19, 2015

(30) Foreign Application Priority Data

Sep. 17, 2013 (JP) ..... 2013-191290

(51) Int. Cl.

| | |
|---|---|
| ***G03G 5/04*** | (2006.01) |
| ***B05B 7/06*** | (2006.01) |
| ***B05B 1/30*** | (2006.01) |
| *B05B 7/12* | (2006.01) |

(52) U.S. Cl.

CPC ..... *G03G 5/04* (2013.01); *B05B 1/3046* (2013.01); *B05B 7/066* (2013.01); *B05B 7/12* (2013.01)

(58) Field of Classification Search

None

See application file for complete search history.

(56) References Cited

U.S. PATENT DOCUMENTS 5,954,112 A * 9/1999 Forbes Jones ..... B22D 23/003 164/271
2006/0286290 A1 12/2006 Wanthal et al.
2013/0230338 A1 9/2013 Kubo et al.

FOREIGN PATENT DOCUMENTS

| | | |
|---|---|---|
| DE | 102007055936 A1 | 7/2009 |
| JP | 2005-125161 | 5/2005 |
| JP | 2005-315963 | 11/2005 |
| JP | 2006-227179 | 8/2006 |
| JP | 2008-070809 | 3/2008 |
| JP | 2010-217329 | 9/2010 |

(Continued)

OTHER PUBLICATIONS

Feb. 20, 2015 European search report in corresponding European patent application No. 14184990.1.

(Continued)

*Primary Examiner* — Nathan T Leong

(74) *Attorney, Agent, or Firm* — Cooper & Dunham LLP

(57) ABSTRACT

A spray gun, which contains: a coating liquid nozzle configured to discharge a coating liquid from an outlet; and a flow channel forming member configured to surround an outer perimeter surface of the coating liquid nozzle to form an air flow channel, through which atomizing air passes, between the outer perimeter surface of the coating liquid nozzle and the flow channel forming member, wherein the spray gun is configured to atomize the coating liquid with the atomizing air to spray the atomized coating liquid to a coating target, wherein a gap T of the narrowest part of the air flow channel is 0.48 mm or smaller, and wherein a ratio T/L of the gap T to a distance L from the narrowest part to an apical surface at which the outlet of the coating liquid nozzle is open is 0.60 or greater.

4 Claims, 3 Drawing Sheets

(56) References Cited

FOREIGN PATENT DOCUMENTS

| | | | |
|---|---|---|---|
| JP | 2011-125769 | | 6/2011 |
| JP | 2012-5949 | | 1/2012 |
| WO | WO2006/138448 | A2 | 12/2006 |
| WO | WO2009/083194 | A1 | 7/2009 |

OTHER PUBLICATIONS

Japanese Official Action dated Jul. 14, 2017 in connection with corresponding Japanese patent application No. 2013-191290.

* cited by examiner

SPRAY GUN FOR COATING, SPRAY COATING DEVICE, AND METHOD FOR PRODUCING ELECTROPHOTOGRAPHIC PHOTOCONDUCTOR

BACKGROUND OF THE INVENTION

Field of the Invention

The present invention relates to a spray gun for coating, which is used for spraying a coating liquid to a coating target, such as an electrophotographic photoconductor, to form a coating film, and a spray coating device and a method for producing an electrophotographic photoconductor, both of which uses the spray gun.

Description of the Related Art

As for a coating method for forming each layer constituting a process target, such as an electrophotographic photoconductor, dip coating has been conventionally employed. However, spray coating has been often used recently (Japanese Patent Application Laid-Open (JP-A) Nos. 2005-315963, 2006-227179, 2008-70809, and 2011-125769). Spray coating is a method where a coating liquid in the form of mist is sprayed from a spray gun to a coating target to form a coating film. This spray gun shears a coating liquid supplied from a coating liquid nozzle with high-speed air (referred to as "atomizing are" hereafter). The coating liquid turned into mist is blown to a coating target along with the atomizing air. The atomizing air passes through a flow channel, which is formed between a coating liquid nozzle and an air (flow channel forming member) cap provided to surround the coating liquid nozzle, and is supplied to the tip of the coating liquid nozzle to thereby shear the coating liquid supplied from the coating liquid nozzle to atomizing the coating liquid (turning the coating liquid into mist).

SUMMARY OF THE INVENTION

Recently, an electrophotographic photoconductor is desired to have high reliability and long service life. Therefore, products, in which a surface protective layer (overcoat layer: OCL) is applied on a photoconductive layer for the purpose of improving abrasion resistance, are available on the market. A surface protective layer of an electrophotographic photoconductor is, in most of cases, formed on a photoconductive layer, specifically a charge transport layer (CTL) of an electrophotographic photoconductor. If the surface protective layer is formed by dip coating, it has been found out that a problem, which is dissolution of an already formed photoconductive layer (charge transport layer) depending on a solvent for use in the dip coating, is caused. It has been confirmed that this problem can be avoided by forming a surface protective layer by spray coating. It is however discovered that the following problem is caused, when a surface protective layer is formed by spray coating.

A spray gun used for spray coating can increase shearing force applied to a coating liquid and make the coating liquid finer, as a flow rate of atomizing air at the time it passes through a tip of a coating liquid nozzle is faster. In spray coating, it is desirable to make the coating liquid finer in view of avoiding coating unevenness. In the conventional art, therefore, developments have been conducted mainly to increase a flow rate of atomizing air at the time it passes through a tip of the coating liquid nozzle, specifically, a flow rate of atomizing air at the time it is brought into contact with a coating liquid discharged from the coating liquid nozzle.

The flow rate of atomizing air in a spray gun at the time when the atomizing air is brought into contact with a coating liquid is typically increased by designing an air flow channel between a coating liquid nozzle and an air cap to be made gradually narrower toward an outlet thereof, to thereby accelerate the flow rate of the atomizing air within the air flow channel. Therefore, it has been considered that a flow rate of atomizing air blown from the air flow channel is increased as the gap of the narrowest part of the air flow channel is narrower, and the flow rate of the atomizing air at the time when the atomizing air is brought into contact with a coating liquid is increased to thereby make the coating liquid finer. Moreover, a speed reduction rate of the flow rate of the atomizing air blown from the air flow channel becomes larger, as the gap of the narrowest part of the air flow channel. Therefore, it is confirmed that a force of the mist-form coating liquid blown to a coating target by the atomizing air is weaken. Considering also this point, coating with the coating liquid without unevenness is realized by narrowing the gap of the narrowest part of the air flow channel.

However, it has been found out by the result of the researches conducted by the present inventors that there is a problem that a surface of a coating target is damaged when a gap of the narrowest part of an air flow channel is made narrow. A specific example thereof is that a surface of a photoconductive layer (charge transport layer) formed before coating is damaged when a surface protective layer of an electrophotographic photoconductor is formed by spray coating, and thus functions of the photoconductive layer (charge transport layer) are spoiled.

The present invention has been accomplished based on the aforementioned problems, and an object of the present invention is to provide a spray gun for coating, a spray coating device, and a method for producing an electrophotographic photoconductor, all of which can perform coating without damaging a surface of a coating target, while preventing coating unevenness through narrowing a gap of the narrowest part of an air flow channel.

In order to achieve the aforementioned object, the spray gun of the present invention contains:

a coating liquid nozzle configured to discharge a coating liquid, which is applied from a coating liquid supplying unit, from an outlet; and a flow channel forming member configured to surround an outer perimeter surface of the coating liquid nozzle to form an air flow channel, through which atomizing air supplied from an atomizing air supply unit passes, between the outer perimeter surface of the coating liquid nozzle and the flow channel forming member, wherein the spray gun is configured to atomize the coating liquid supplied from the outlet of the coating liquid nozzle with the atomizing air supplied from the air flow channel to spray the atomized coating liquid to a coating target, wherein a gap T of the narrowest part of the air flow channel is 0.48 mm or smaller, and wherein a ratio T/L of the gap T of the narrowest part of the air flow channel to a distance L from the narrowest part to an apical surface at which the outlet of the coating liquid nozzle is open is 0.60 or greater.

The present invention can exhibit excellent effects, which are to perform coating without damaging a surface of a coating target, while preventing coating unevenness through narrowing a gap of the narrowest part of an air flow channel.

DETAILED DESCRIPTION OF THE INVENTION

One embodiment of the present invention is explained with reference to drawings, hereinafter.

Figure 1:
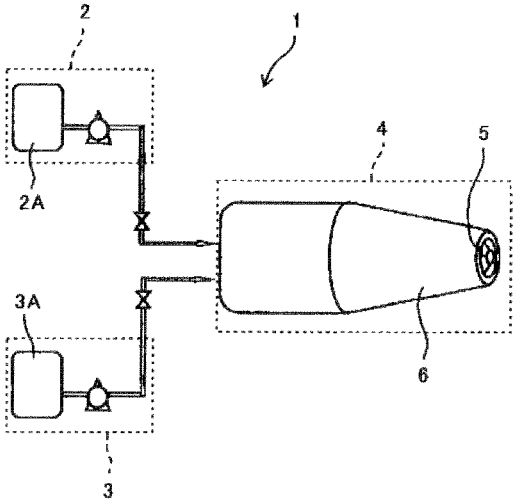
FIG. 1 is a schematic diagram illustrating one example of a schematic structure of a spray coating device for an electrophotographic photoconductor according to the present embodiment.

FIG. 1 is a schematic diagram illustrating one example of a schematic structure of a spray coating device for an electrophotographic photoconductor according to the present embodiment.

The spray coating device 1 of the present embodiment contains coating liquid supplying unit 2, an atomizing air supply unit 3, and a spray gun 1. The spray gun 4 is connected to both the coating liquid supplying unit 2 and the atomizing air supply unit 3, and is designed so that a coating liquid 2A and atomizing air 3A are supplied from the coating liquid supplying unit 2 and the atomizing air supply unit 3, respectively. The spray gun 4 contains a coating liquid nozzle 5 configured to discharge the coating liquid 2A, which is supplied from the coating liquid supplying unit 2, from an outlet, and an air cap 6, which is a flow channel forming member configured to form an air flow channel, through which the atomizing air 3A supplied from the atomizing air supply unit 3 passes, between an outer perimeter surface of the coating liquid nozzle 5 and the flow channel forming member.

From the coating liquid supplying unit 2, the coating liquid 2A, the viscosity, or solvent vapor pressure of which has been adjusted, is supplied. The atomizing air, the pressure of which has been adjusted (controlled by adjusting a flow rate thereof), is supplied from the atomizing air supply unit 3. As the spray gun 4 has the aforementioned structure, the spray gun 4 shears the coating liquid 2A discharged from the coating liquid nozzle 5 with the atomizing air. The coating liquid turned into mist is then blown together with the atomizing air to a coating target (an electrophotographic photoconductor before subjected to coating).

Figure 2:
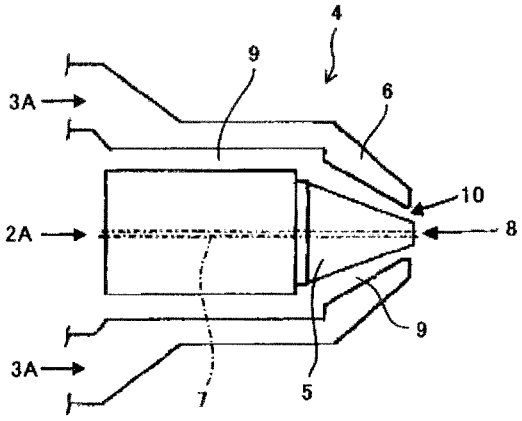
FIG. 2 is a schematic diagram illustrating one example of a spray gun for use in the spray coating device.

FIG. 2 is a schematic diagram illustrating one example of the spray gun 4 of the present embodiment.

The spray gun 4 of the present embodiment is composed of a coating liquid nozzle 5 in the form of a truncated cone, and, an air cap 6 in the form of a hollow truncated cone. The coating liquid nozzle 5 contains therein a coating liquid flow channel 7, through which the coating liquid 2A is supplied. The coating liquid flow channel 7 is connected to an outlet 8, which is open at an apical surface of the coating liquid nozzle 5. Moreover, an outlet 10 of the air flow channel 9 formed between the air cap 6 and the coating liquid nozzle 5 is open at the area adjacent to the so apical surface of the coating liquid nozzle 5. Through the air flow channel 9, the atomizing air 3A is supplied.

Figure 3:
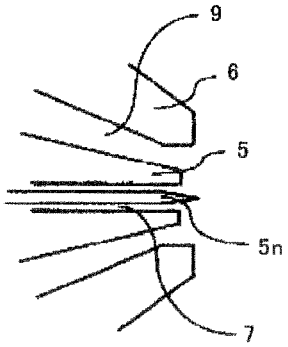
FIG. 3 is an enlarged view illustrating a schematic structure of a tip part of the spray gun.

FIG. 3 is an enlarged view illustrating a schematic structure of a tip part of the spray gun 4.

As illustrated in FIG. 3, a needle 5*n* is provided inside the coating liquid flow channel 7 of the coating liquid nozzle 5. This needle 5*n* is movably supported forward and backward by the needle moving unit (not illustrated) with respect to the outlet 8 of the coating liquid flow channel 7. When the needle 5*n* is in the backward position as illustrated in FIG. 3, a gap is formed between the outlet 8 of the coating liquid flow channel 7 and the needle 5*n*, so that the coating liquid 2A inside the coating liquid flow channel 7 is discharged from the outlet 8. When the needle 5*n* is in the forward position (not illustrated), on the other hand, the outlet 8 of the coating liquid flow channel 7 is closed with the needle 5*n*, so that the coating liquid 2A inside the coating liquid flow channel 7 cannot be discharged from the outlet 8.

Figure 4:
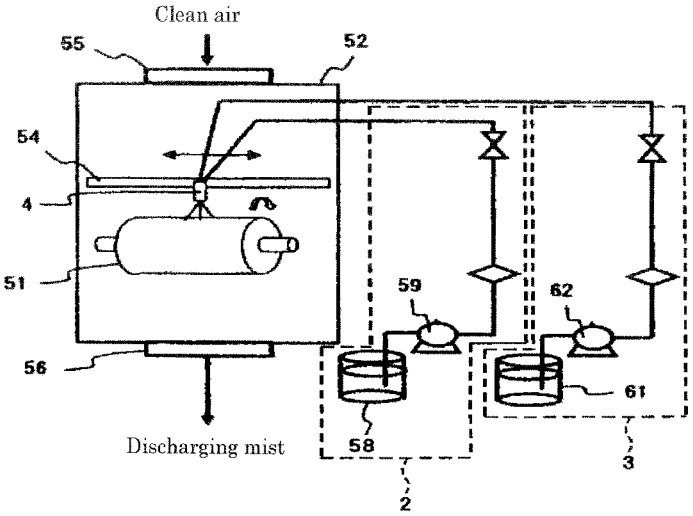
FIG. 4 is a schematic diagram illustrating a structure example of a coating system when an electrophotographic photoconductor, which is before subjected to coating, is spray coated with a coating liquid for a surface protective layer using the spray coating device.

FIG. 4 is a schematic diagram illustrating one structural example of a coating system, when a coating target, which is an electrophotographic photoconductor before subjected to coating, is spray coated with a coating liquid for a surface protective layer using the spray coating device 1 of the present embodiment.

The coating target 51 is rotatably supported by a rotatably supporting unit (not illustrated) inside a coating booth 52. The spray gun 4 is movably attached to a guide rail 54 along the axial direction of the coating target 51. To the coating booth 52, provided are a clean air supply port 55 and an outlet 56 for discharging excessive spray mist atomized from the spray gun 4. The coating liquid 2A is supplied from a coating liquid tank 58 of the coating liquid supplying unit 2 by a pump 59, and the atomizing air 3A is also supplied from an atomizing air tank 61 of the atomizing air supply unit 3 by a pump 62, to form the coating liquid 2A into fine particles, and to thereby spray the coating liquid onto the coating target 51 from the spray gun 4.

A positional relationship between the coating liquid nozzle 5 of the spray gun 4 and the air gap 6 for use in the method for producing an electrophotographic photoconductor or the sizes thereof are as follow. As mentioned later, the gap T of the narrowest part of the air flow channel 9 is set to be 0.48 mm or smaller, and the distance L is set so that the ratio T/L, which is a ratio of the gap T of the narrowest part of the air flow channel 9 to the distance L from the narrowest part to the apical surface 5*a* of the coating liquid nozzle to be 0.60 or greater. As described later, use of the spray gun adjusted as mentioned above reduces a damage to a charge transport layer before forming a surface protective layer by the spray gun 4, to thereby realize coating that does not adversely affect the functions of the charge transport layer.

In the case where an electrophotographic photoconductor is produced using the spray coating device 1 equipped with the spray gun 4, the pressure of the atomizing air 3A to be supplied is preferably 0.01 MPa to 0.2 MPa just before being introduced into the spray gun 4. The more preferable range thereof is 0.02 MPa to 0.1 MPa, and the particularly preferable range thereof is 0.04 MPa to 0.07 MPa. When the pressure of the atomizing air is lower than 0.01 MPa, the coating liquid 2A is not sufficiently turned into fine particles, and therefore unevenness may be formed in a coating film. When the pressure thereof is greater than 0.2 MPa, the force of blowing the coating liquid 2A in the form of mist to the coating target 51 is too strong, and therefore unevenness may be formed in a coating film. Note that, the pressure of the atomizing air 3A can be controlled by adjusting a flow rate of the atomizing air 3A.

In the case where an electrophotographic photoconductor is produced using the spray coating device 1 equipped with the spray gun 4, moreover, the discharge speed for discharging the coating liquid 2A from the outlet 8 of the coating liquid nozzle 5 is preferably 1 cc/min to 30 cc/min. The more preferable range thereof is 2 cc/min to 15 cc/min.

In the case where an electrophotographic photoconductor is produced using the spray coating device 1 equipped with the spray gun 4, moreover, a distance from the tip of the spray gun 4 to the coating target 51 is preferably 10 mm to 100 mm. The more preferable range thereof is 30 mm to 70 mm.

Figure 5:
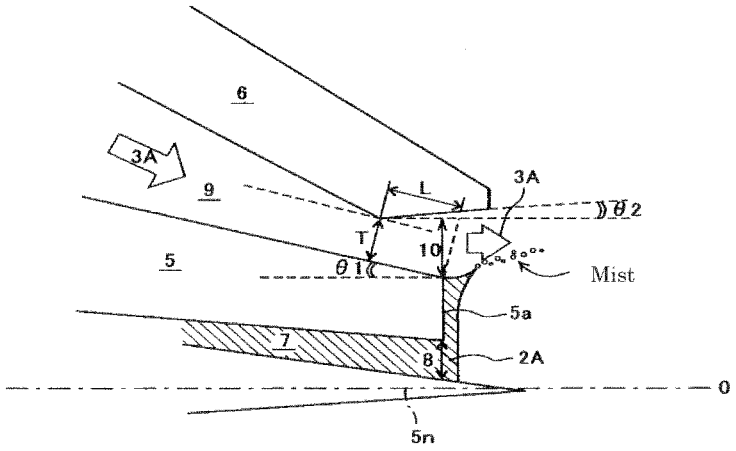
FIG. 5 is a schematic diagram illustrating one example of a state of a coating liquid sheared by atomizing air.

FIG. 5 is a schematic diagram illustrating one example of a state of the coating liquid 2A sheared with the atomizing air 3A.

In the spray gun 4 of the present embodiment, the coating liquid 2A supplied from the coating liquid supplying unit 2 is discharged from the outlet 8 via the coating liquid flow channel 7, and at the same time, the atomizing air 3A supplied from the atomizing air supply unit 3 is blown off from the outlet 10 via the air flow channel 9. The coating liquid 2A discharged from the outlet 8 of the coating liquid flow channel 7 is moved along the apical surface 5*a* of the coating liquid nozzle 5, and moved to the outlet 10 of the air flow channel 9, by the negative pressure effect caused by a flow of the atomizing air blown from the air flow channel 9. The coating liquid 2A comes close to the boundary between the apical surface 5*a* and the outlet 10 is then sheared by the atomizing air 3A to be scattered in the form of mist, and then sprayed from the spray gun 4 along the flow of the atomizing air 3A.

The smaller particle diameters of the coating liquid 2A in the form of mist, which is sprayed from the spray gun 4, are preferable, in view of reduction in coating unevenness. In order to make the coating liquid 2A finer, an increase in the shearing force applied to the coating liquid 2A by the atomizing air 3A is effective. To this end, it is effective to increase a flow rate of the atomizing air 3A when the atomizing air 3A is brought into contact with the coating liquid 2A. Therefore, the spray gun of the present embodiment is designed so that the air flow channel 9 is gradually made narrower towards the outlet 10 thereof, to accelerate the flow rate of the atomizing air 3A in the air flow channel 9. In such a structure, the gap T of the narrowest part of the air flow channel 9 greatly affect a flow rate of atomizing air blown from the air flow channel 9. Specifically, the flow rate of the atomizing air at the time when the atomizing air is brought into contact with the coating liquid is increased to make the coating liquid finer, as the gap T of the narrowest part of the air flow channel 9 is made narrower. In addition, a speed reduction rate of the flow rate of the atomizing air 3A blown from the air flow channel 9 is increased, as the gap T of the narrowest part of the air flow channel 9 is made narrower, and therefore a force of the coating liquid 2A in the form of mist blown to a coating target by the atomizing air 3A is weaken. Typically, the weaker force of blowing the coating liquid is more advantageous in view of avoiding coating unevenness. Therefore, to narrow the gap T of the narrowest part of the air flow channel 9 enables to turn the coating liquid 2A blown finer, and to reduce a force of blowing, and thus coating of the coating liquid 2A without coating unevenness can be realized.

As mentioned earlier, however, a surface of a layer that is formed before coating is damaged, when coating is performed with the narrowed gap T of the narrowest part of the air flow channel 9, and it has been confirmed that there is a problem that original functions of the layer is impaired. Specifically, a surface of a photoconductive layer (charge transport layer) that is formed before coating is damaged when a surface protective layer of an electrophotographic photoconductor is applied by spray coating, and functions of the photoconductive layer (charge transport layer) are impaired.

Since the gap T of the narrowest part of the air flow channel 9 is made narrow as mentioned above, the coating liquid 2A blown is made finer, and a force of blowing is weaken. Accordingly, damage applied when the coating liquid 2A is hit into a coating target (an electrophotographic photoconductor before coating) is reduced. Typically, it is hardly imagined that a surface of a photoconductive layer before coating will be damaged. Therefore, the present inventors have studied in details about a cause for damaging a surface of a layer formed before coating, and have reached to the following conclusion.

First, a part where a roughened surface of a photoconductive layer (charge transport layer) formed before coating is present for a relatively long period. This means that a coating treatment, which would give a degree of damage that would roughen a surface of the photoconductive layer (charge transport layer) before coating is performed, as the coating duration passes a certain period of time. When a part at which such damage is not cause is observed, it is confirmed that coating unevenness is sufficiently prevented. Accordingly, at the part where no damage is cause, the coating liquid 2A is sufficiently formed into fine particles with a shearing force of the atomizing air 3A, and a force of blowing is sufficiently weak, and therefore coating unevenness is sufficiently prevented.

Comprehensively considering these results and other information, the cause seems to be as follows.

As illustrated in FIG. 5, the coating liquid 2A discharged from the outlet 8 of the coating liquid flow channel 7 is moved along the apical surface 5*a* of the coating liquid nozzle 5 by the negative pressure effect of the atomizing air 3A. Then, the coating liquid 2A receives shearing from the atomizing air 3A adjacent to the boundary between the apical surface 5*a* of the coating liquid nozzle 5 and the outlet 10 of the air flow channel 9, cut out the particle-form coating liquid 2A from the fluid itself attached to the apical surface 5*a*. Thereafter, the cut-out particle-form coating liquid 2A is transported with the atomizing air 3A, as well as being stirred by the atomizing air 3A to be made finer.

The flow rate of the atomizing air 3A at the time when the atomizing air 3A passes through the narrowest part can be increased by narrowing the gap T of the narrowest part of the air flow channel 9. However, disturbance is caused in a flow of the atomizing air 3A depending on the state of the flow channel during the time from the atomizing air 3A passing through the narrowest part to being in contact with the coating liquid 2A, to thereby disturb the part of a flow of the atomizing air 3A at which the atomizing air 3A is in contact with the coating liquid 2A. If such disturbance of a flow of the atomizing air 3A is not caused, the coating liquid 2A moving along the apical surface 5*a* of the coating liquid nozzle 5 can be continuously cut out at a certain point. If such disturbance of a flow of the atomizing air 3A is caused, however, the coating liquid 2A cannot be cut out at a certain point, and the coating liquid 2A moving along the apical surface 5*a* of the coating liquid nozzle 5 elevates into the outlet 10 of the air flow channel 9. When a certain amount of the coating liquid 2A is elevated after a certain period, the coating liquid 2A is cut out at a draft by the atomizing air 3A. The coating liquid 2A cut out by this has the larger particle diameter than a typical diameter, and therefore significant damage is given to an area of a surface of a coating target, to which the coating liquid A is hit by blown thereto with the atomizing air. It is assumed that a problem where a surface of a layer formed before coating is roughened is caused by repeating a phenomenon, in which the coating liquid 2A is gradually elevated into the outlet 10 of the air flow channel 9, and is then cut out by the atomizing air 3A at a draft, with a certain cycle.

Based on the aforementioned discussion, the present inventors have found that it is effective to shorten the length L of a part of the air flow channel, in order to prevent disturbance in a flow of the atomizing air, which would cause the aforementioned phenomenon in the part of the air flow channel, from passing through the narrowest part thereof to being in contact with the coating liquid 2A. However, it is considered from the experimental results explained below that the tolerance (the upper limit) of the length L of the air flow channel part that can prevent the disturbance of a flow in the air flow channel part becomes narrower, as the gap T of the narrowest part is narrower. In the case where the gap T of the narrowest part is greater than the certain gap, moreover, it is found that disturbance of a flow in the air flow channel part cannot be sufficiently prevented even by reducing the length L of the air low channel part, and it is difficult to prevent the aforementioned phenomenon.

EXAMPLES

In this experiment, a surface protective layer of an electrophotographic photoconductor was applied under conditions each of Examples 1 to 10, and Comparative Examples 1 to 6 explained below, and a damage (roughness of a surface) given to a charge transport layer when coated with the surface protective layer was evaluated. Note that, "part(s)" described below is "part(s) by weight," unless otherwise stated.

Example 1

The undercoat coating layer, the charge generation layer coating liquid, and the charge transport layer coating layer, which had the following compositions, were sequentially applied and dried on an aluminum cylinder having a diameter of 60 mm, to thereby form an undercoat layer of 2.5 μm, a charge generation layer of 0.2 μm, and a charge transport layer of 25 μm. The applications of these layer coating liquids were all performed by dip coating. On the charge transport layer, moreover, the surface protective r coating liquid having the following composition was applied by means of a two-flow spray gun. As for the coating performed in this experiment, the coating system illustrated in FIG. 4 was used, and a basic structure of the two-flow spray gun was the same as that of the present embodiment. After the spray coating, UV light was applied to the surface protective layer coating liquid by means of a UV radiation device available from Noblelight Fusion, followed by drying, to thereby form a surface protective layer of 3.5 μm,

[Undercoat Layer Coating Liquid]

| | |
|---|---|
| Alkyd resin (BECKOSOL 1307-60-EL, manufactured by DIC Corporation) | 6 parts |
| Melamine resin (SUPER BECKAMINE G-821-60, manufactured by DIC Corporation) | 4 parts |
| Titanium oxide | 40 parts |
| Methyl ethyl ketone | 50 parts |

[Charge Generation Layer Coating Liquid]

| | |
|---|---|
| Titanyl phthalocyanine pigment represented by the following structural formula (I) | 1.5 parts |
| Polyvinyl butyral (XYHL, manufactured by Union Carbide Corporation) | 1.0 part |
| Methyl ethyl ketone | 80 parts |

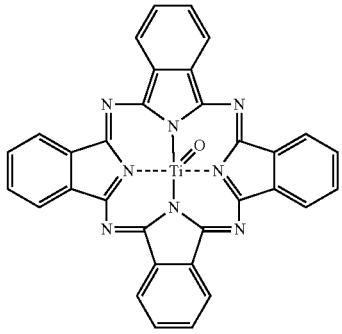

Structural Formula (I)

[Charge Transport Layer Coating Liquid]

| | |
|---|---|
| Bisphenol Z polycarbonate (Panlite TS-2050. manufactured by Teijin Limited) | 10 parts |
| Low-molecular weight charge transport material represented by the following structural formula (II) | 10 parts |
| Tetrahydrofuran | 100 parts |
| 1% silicone oil tetrahydrofuran solution (KF50-100CS, manufactured by Shin-Etsu Chemical Co., Ltd.) | 0.2 parts |

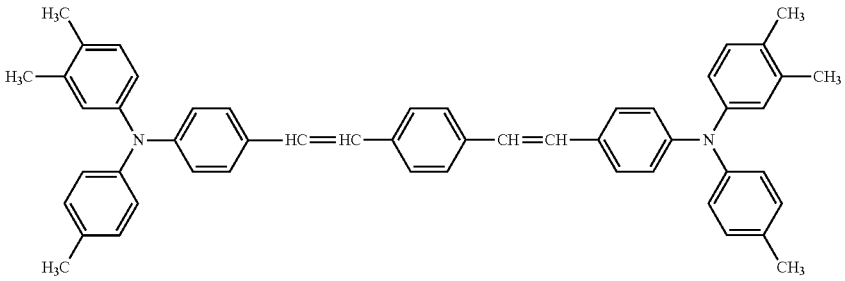

Structural Formula (II)

[Protective Layer Coating Liquid]
[Mill Base]

| | |
|---|---|
| Alumina filler (Sumicorundum AA03, manufactured by Sumitomo Chemical Co., Ltd., the average primary particle diameter: 0.3 μm) | 8 parts |
| Polycarboxylic acid compound (low-molecular weight unsaturated polycarboxylic acid polymer solution, BYK-P104, manufactured by BYK Japan K. K., non-volatile component: 50%, acid value: 180 mgKOH/g) | 0.2 parts |
| Cyclopentanone | 8 parts |
| Tetrahydrofuran | 12 parts |

[Protective Layer Coating Liquid]

| | |
|---|---|
| Mill base | 6.5 parts |
| Radical polymerizable compound having a charge transport structure and expressed by the following structural formula: | 10 parts |

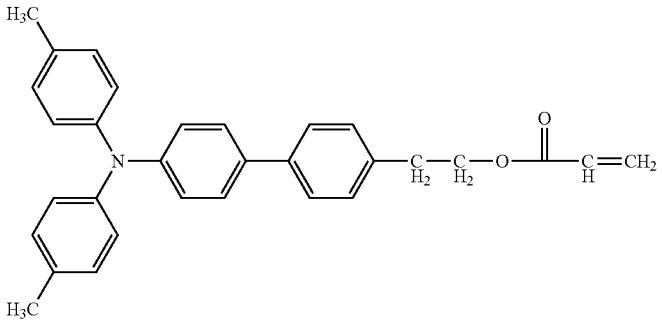

| | |
|---|---|
| Trifunctional or higher radical polymerizable monomer having no charge transport structure | |
| Trimethylol propane triacrylate (KAYARAD TMPTA, manufactured by Nippon Kayaku Co., Ltd., molecular weight: 296, the number of functional groups: 3) | 5 parts |
| Dipentaerythritol caprolactone-modified hexaacrylate (KAYARAD DPCA-120, manufactured by Nippon Kayaku Co., Ltd., molecular weight: 1,947, the number of functional groups: 6) | 5 parts |
| Photopolymerization initiator | |
| 1-hydroxy-cyclohexyl-phenyl-ketone (IRGACURE 184, manufactured by BASF, molecular weight: 204) | 1 part |
| Leveling agent | |
| BYK-UV3570 (manufactured by BYK Japan K. K.) | 0.2 parts |
| Solvent | |
| Tetrahydrofuran | 115 parts |

[Size and Angle of Spray Gun]
T=0.18 mm
L=0.10 mm
T/L=1.80
θ1=15 degrees
θ2=0 degrees
[Spray Coating Conditions]
Spray distance: 40 mm
Coating liquid discharge speed: 4.7 cc/min
Spray traveling speed: 6 mm/s
Drum rotational speed: 165 rpm
Atomizing air pressure: 55 kPa
Coating time: once Example 2

The same procedure to that of Example 1 was carried out, provided that the size and angle of the spray gun and the spray coating conditions were changed as follows.

[Size and Angle of Spray Gun]
T=0.18 mm
L=0.30 mm
T/L=0.60
θ1=15 degrees
θ2=0 degrees
[Spray Coating Conditions]
Spray Distance: 40 mm
Coating liquid discharge speed: 4.7 cc/min
Spray traveling speed: 6 mm/s
Drum rotational speed: 165 rpm
Atomizing air pressure: 55 kPa
Coating time: once Example 3

The same procedure to that of Example 1 was carried out, provided that the size and angle of the spray gun and the spray coating conditions were changed as follows.

[Size and Angle of Spray Gun]
T=0.24 mm
L=0.14 mm
T/L=1.71
θ1=15 degrees
θ2=0 degrees
[Spray Coating Conditions]
Spray distance: 40 mm
Coating liquid discharge speed: 4.7 cc/min
Spray traveling speed: 6 mm/s
Drum rotational speed: 165 rpm
Atomizing air pressure: 55 kPa
Coating time once Example 4

The same procedure to that of Example 1 was carried out, provided that the size and angle of the spray gun and the spray coating conditions were changed as follows.
[Size and Angle of Spray Gun]
T=0.24 mm
L=0.40 mm
T/L=0.60
θ1=15 degrees
θ2=0 degrees
[Spray Coating Conditions]
Spray distance: 40 mm
Coating liquid discharge speed: 4 cc/min
Spray traveling speed: 6 min/s
Drum rotational speed: 165 rpm
Atomizing air pressure: 55 kPa
Coating time: once Example 5

The same procedure to that of Example 1 was carried out, provided that the size and angle of the spray gun and the spray coating conditions were changed as follows.
[Size and Angle of Spray Gun]
T=0.36 mm
L=0.20 mm
T/L=1.80
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: 55 kPa
Coating time: once Example 6

The same procedure to that of Example 1 was carried out, provided that the size and angle of the spray gun and the spray coating so conditions were changed as follows.
[Size and Angle of Spray Gun]
T=0.36 mm
L=0.60 mm
T/L=0.60
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: kPa
Coating time: once Example 7

The same procedure to that of Example 1 was carried out, provided that the size and angle of the spray gust and the spray coating conditions were changed as follows.
[Size and Angle of Spray Gun]
T=0.48 mm
L=0.28 mm
T/L=1.71
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: 55 kPa
Coating time: once Example 8

The same procedure to that of Example 1 was carried out, provided that the size and angle of the spray gun and the spray coating conditions were changed as follows.
[Size and Angle of Spray Gun]
T=0.48 mm
L=0.80 mm
T/L=0.60
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: 55 kPa
Coating time: once Example 9

The same procedure to that of Example 1 was carried out, provided that the size and angle of the spray gun and the spray coating conditions were changed as follows.
[Size and Angle of Spray Gun]
T=0.18 mm
L=0.10 mm
T/L=1.80
θ1=0 degrees
θ2=0 degrees
[Spray Coating Conditions]
Spray distance: 40 mm
Coating liquid discharge speed: 4.8 cc/min
Spray traveling speed: 6 minis
Drum rotational speed: 165 rpm
Atomizing air pressure: 55 kPa
Coating time once Example 10

The same procedure to that of Example 1 was carried out, provided that the size and angle of the spray gun and the spray coating conditions were changed as follows.
[Size and Angle of Spray Gun]
T=0.18 mm
L=0.10 mm
T/L=1.80
θ1=15 degrees
θ2=15 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing pressure: 55 kPa
Coating time: once Comparative Example 1

The same procedure to that of Example 1 was carried out, provided that the size and angle of the spray gun and the spray coating conditions were changed as follows.
[Size and Angle of Spray Gun]
T=0.60 mm
L=0.33 mm
T/L=1.82
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: 55 kPa
Coating time: once Comparative Example 2

The same procedure to that of Example 1 was carried out, provided that the size and angle of the spray gun and the spray coating conditions were changed as follows.
[Size and Angle of Spray Gun]
T=0.60 mm
L=1.00 mm
T/L=0.60
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: 55 kPa
Coating time: once Comparative Example 3

The same procedure to that of Example 1 was carried out, provided that the size and angle of the spray gun and the spray coating conditions were changed as follows.
[Size and Angle of Spray Gun]
T=0.18 mm
L=0.60 mm
T/L=0.30
θ1=15 degrees
θ2=0 degrees
[Spray Coating Conditions]
Spray distance: 40 mm
Coating liquid discharge speed: 4.6 cc/min
Spray traveling speed: 6 mm/s
Drum rotational speed: 165 rpm
Atomizing air pressure: 55 kPa
Coating time: once Comparative Example 4

The same procedure to that of Example 1 was carried out, provided that the size and angle of the spray gun and the spray coating conditions were changed as follows.
[Size and Angle of Spray Gun]
T=0.24 mm
L=0.80 mm
T/L=0.30
θ1=15 degrees
θ2=0 degrees
[Spray Coating Conditions]
Spray distance: 40 mm
Coating liquid discharge speed: 4.6 cc/min
Spray traveling speed: 6 mm/s
Drum rotational speed: 165 rpm
Atomizing air pressure: 55 kPa
Coating time: once Comparative Example 5

The same procedure to that of Example 1 was carried out, provided that the size and angle of the spray gun and the spray coating conditions were changed as follows.
[Size and Angle of Spray Gun]
T=0.36 mm
L=L20 mm
T/L=0.30
θ1=15 degrees
θ2=0 degrees
[Spray Coating Conditions]
Spray distance: 40 mm
Coating liquid discharge speed: 4.7 cc/min
Spray traveling speed: 6 mm/s
Drum rotational speed: 165 rpm
Atomizing air pressure: 55 kPa
Coating time: once Comparative Example 6

The same procedure to that of Example 1 was carried out, provided that the size and angle of the spray gun and the spray coating conditions were changed as follows.
[Size and Angle of Spray Gun]
T=0.60 mm
L=2.00 mm
T/L=0.30
θ1=15 degrees
θ2=0 degrees
[Spray Coating Conditions]
Spray distance: 40 mm
Coating liquid discharge speed: 4.8 cc/min
Spray traveling speed: 6 mm/s
Drum rotational speed: 165 rpm
Atomizing air pressure: 55 kPa
Coating time: once Evaluations of Examples and Comparative Examples The electrophotographic photoconductors of Examples 1 to 10 and Comparative Examples 1 to 6 produced in the aforementioned manners were first visually inspected under a black light. When light is applied from the black light, the underlying charge transport layer is illuminated. Therefore, damage on the charge transport layer caused by spray coating of the surface protective layer can be visually confirmed as a shape of uneven luminescence. The evaluation criteria for the visual inspection were as depicted in the following table 1.

TABLE 1

| Evaluation rank | Luminescence unevenness (visual inspection) |
|---|---|
| A | Excellent, no unevenness was confirmed. |
| B | Faint unevenness was confirmed partially, but not problematic. |
| C | Faint unevenness was confirmed all over. |
| D | Clear unevenness was confirmed all over. |

Subsequently, an image evaluation was performed on the electrophotographic photoconductors of Examples 1 to 10 and Comparative Examples 1 to 6. As for the image evaluation, used as a modified device of a digital full-color photocopier RICOH Pro C751EX manufactured by Ricoh Company Limited, in which the electrophotographic photoconductor to be evaluated was mounted in a process cartridge, and a charging unit, an exposing unit, a developing unit, a transferring unit, a fixing unit, a leaning unit, a lubricant coating unit, and a diselectrification unit were mounted. The electrophotographic photoconductor was subjected to a NOx gas exposure test in advance. After outputting 20,000 sheets (full color, A4, image area rate: 5%) in the low temperature low humidity environment (10° C., 15% RH), an image was output and the image density unevenness thereof was evaluated. The image for use in the evaluation was an A3 image of 2-dot half tone, and the evaluation visually performed. The evaluation criteria of the image density unevenness were as depicted in the following table 2.

TABLE 2

| Evaluation rank | Image density unevenness (visual inspection) |
|---|---|
| A | Excellent, no unevenness was confirmed. |
| B | Unevenness was confirmed in a part of the image, but acceptable. |
| C | Faint unevenness was confirmed all over the image. |
| D | Clear unevenness was confirmed all over the image. |

The results of the visual inspection and image evaluation of the electrophotographic photoconductors were as presented in Table 3.

TABLE 3

| | L [mm] | T [mm] | T/L | θ1 [°] | θ2 [°] | Visual inspection | Image inspection |
|---|---|---|---|---|---|---|---|
| Ex. 1 | 0.10 | 0.18 | 1.80 | 15 | 0 | A | A |
| Ex. 2 | 0.30 | 0.18 | 0.60 | 15 | 0 | A | A |
| Ex. 3 | 0.14 | 0.24 | 1.71 | 15 | 0 | A | A |
| Ex. 4 | 0.40 | 0.24 | 0.60 | 15 | 0 | A | A |
| Ex. 5 | 0.20 | 0.36 | 1.80 | 15 | 0 | B | A |
| Ex. 6 | 0.60 | 0.36 | 0.60 | 15 | 0 | B | B |
| Ex. 7 | 0.28 | 0.48 | 1.71 | 15 | 0 | B | B |
| Ex. 8 | 0.80 | 0.48 | 0.60 | 15 | 0 | B | B |
| Ex. 9 | 0.10 | 0.18 | 1.80 | 0 | 0 | A | A |
| Ex. 10 | 0.10 | 0.18 | 1.80 | 15 | 15 | A | A |
| Comp. Ex. 1 | 0.33 | 0.60 | 1.82 | 15 | 0 | C | C |
| Comp. Ex. 2 | 1.00 | 0.60 | 0.60 | 15 | 0 | C | C |
| Comp. Ex. 3 | 0.60 | 0.18 | 0.30 | 15 | 0 | D | D |
| Comp. Ex. 4 | 0.80 | 0.24 | 0.30 | 15 | 0 | D | D |
| Comp. Ex. 5 | 1.20 | 0.36 | 0.30 | 15 | 0 | D | D |
| Comp. Ex. 6 | 2.00 | 0.60 | 0.30 | 15 | 0 | D | D |

When the evaluation rank is "B" or better in the visual inspection and image inspection, it can be evaluated that damage on the charge transport layer due to the formation of the surface protective layer by spray coating can be sufficiently prevented.

First, in Examples 1 to 8, the evaluation rank of "B" or better as in the visual inspection and image inspection, when the gap T of the narrowest part of the air flow channel 9 was narrowed to 0.48 mm or smaller. In Comparative Examples 3 to 5, however, the evaluation rank in the visual inspection and image inspection was "D," even when the gap T of the narrowest part of the air flow channel 9 was 0.48 mm or smaller. It is assumed that this is because of an influence of the distance L from the narrowest part of the air flow channel 9 to the apical surface 5*a* of the coating liquid nozzle 5. According to the discussion described above, which explains that a cause is disturbance of atomizing air in the part of the air flow channel from the narrowest part of the air flow channel 9 to the apical surface 5*a* of the coating liquid nozzle 5, the reason for the evaluation rank "D" attained in Comparative Examples 3 to 5 is because the disturbance of the atomizing air in the air flow channel part becomes less, as the length L of the air flow channel part is shorter.

In Comparative Examples 3 and 4, however, the evaluation rank in the visual inspection and image inspection was "D" even through the distance L from the narrowest part of the air flow channel 9 to the apical surface 5*a* of the coating liquid nozzle 5 was relatively short, i.e., 0.6 mm, and 0.8 mm, respectively. In Examples 6 and 8, on the other hand, the evaluation rank in the visual inspection and image inspection was "B", even through the distance L from the narrowest part of the air flow channel 9 to the apical surface 5*a* of the coating liquid nozzle 5 was respectively 0.6 mm, and 0.8 mm, as in Comparative Examples 3 and 4. Studying this difference, the gap T was relatively widely set in Examples 6 and 8, i.e., 0.36 mm, and 0.48 mm, respectively, whereas the gap T was is set relatively narrow in Comparative Examples 3 and Comparative Example 4, i.e., 0.18 mm, and 0.24 mm. It is considered from these results that the tolerance (upper limit) the distance L required to attain the evaluation rank of "B" or better in the visual inspection and image inspection becomes narrower, as the gap T of the narrowest part of the air flow channel 9 is narrower. It is assumed that the atomizing air tends to be disturbed in the part of the air flow channel from the narrowest part to the apical surface 5*a* of the coating liquid nozzle 5, because a force of the atomizing air blown from the narrowest part becomes stronger, as the gap T of the narrowest part of the air flow channel 9 is narrower.

Looking at the ratio T/L as an index value, moreover, the evaluation rank of "B" or better can be attained, if the distance L is set relative to the distance T of the narrowest part to satisfy the condition that the ratio T/L is 0.60 or greater.

In Comparative Examples 1 and 2, however, the evaluation rank in the visual inspection and image inspection was "C" even through the ratio T/L was 0.60 or greater. Especially in Comparative Example 1, the evaluation rank was "C" even through the distance L from the narrowest part of the air flow channel 9 to the apical surface 5*a* of the coating liquid nozzle 5 was set narrow, i.e., 0.33. It is considered from this result that it is difficult to attain the evaluation rank of "B" or better in the case where the gap T of the narrowest part of the air flow channel 9 is wide and is 0.60 or greater, even through setting the distance L short. This is because a force of blowing the coating liquid to the coating target is strong, as well as insufficiently forming the coating liquid into fine particles due to a slow flow rate of the atomizing air, and therefore damage is caused on the charge transport layer, in the case where the gap T of the narrowest part of the air flow channel 9 is wide and is 0.60 or greater. In this case, it is considered that the aforementioned phenomenon, where the coating liquid 2A is gradually elevated into the outlet 10 of the air flow channel 9, and the coating liquid of large particle diameters is cut out at a draft by the atomizing air 3A at a certain moment, is not caused, and therefore it is assumed that there is no effect even when disturbance of a flow is prevented by reducing the distance L.

As illustrated in FIG. 5, in the spray gun 4 of the present embodiment, the angle θ1 formed between the outer perimeter surface of the tapered tip part of the coating liquid nozzle 5 constituting the air flow channel 9 and a central axis O of the spray gun, and the angle θ2 formed between the inner wall surface of the air cap 6 forming the air flow channel part from the narrowest part of the air flow channel 9 to the top of the air cap 6, and the central axis O of the spray gun are not particularly limited. However, the angle θ1 and the angle θ2 preferably satisfy the following conditions: $\theta1 \geq \theta2$, $\theta1 \geq 0°$, and $\theta2 \geq 0°$.

Moreover, the present embodiment is an example of the present invention, where a coating target is an electrophotographic photoconductor before coating, and the coating target is coated with a surface protective layer, but the present invention is not limited to this example, and can be widely applied, as long as a coating target, which is easily damaged by coating, is coated.

Above explained is an example. The present invention exhibits a special effect per embodiment described as follow.

Embodiment A

Embodiment A is characterized that a spray gun 4, which contains a coating liquid nozzle 5 configured to discharge a coating liquid 2A, which is supplied from a coating liquid supplying unit 2, from an outlet 8, and a flow channel forming member, such as an air gap 6, configured to surround an outer perimeter surface of the coating liquid nozzle to form an air flow channel 9, through which atomizing air 3A supplied from an atomizing air supply unit 3 passes, between the outer perimeter surface of the coating liquid nozzle and the flow channel forming member, in which the spray gun 4 is configured to atomize the coating liquid 2A supplied from the outlet 8 of the coating liquid nozzle with the atomizing air 3A supplied from the air flow channel 9 to spray the atomized coating liquid to a coating target 51, such as an electrophotographic photoconductor (before forming a surface protective layer), in which a gap T of the narrowest part of the air flow channel is 0.48 mm or smaller, and in which a ratio T/L of the gap T of the narrowest part of the air flow channel to an apical surface 5*a* at which the outlet 8 of the coating liquid nozzle is open is 0.60 or greater.

A cause for damaging a surface of a coating target is, as considered above, that a phenomenon, in which the coating liquid 2A moves along the apical surface 5*a* of the coating liquid nozzle 5 is gradually elevated into the outlet 10 of the air flow channel 9, and at a certain moment, the coating liquid is cut out at a draft, is repeated. Specifically, as this phenomenon is repeated, the coating liquid of large particle diameters is periodically blown to the coating target, and an impact given then damages a surface of the coating target, to roughen the surface of the coating target. By setting the gap T of the narrowest part of the air flow channel to the range of 0.48 mm or smaller, as well as setting the distance L narrow to give the ratio T/L of 0.60 or greater, as in the present embodiment, disturbance of atomizing air caused at the air channel region from the narrowest part of the air flow channel to the apical surface 511 of the coating liquid nozzle 5 can be prevented. As a result, stable excision (shearing) of the coating liquid with the atomizing air is realized, and the aforementioned phenomenon is prevented.

Embodiment B

Embodiment B is characterized that the gap T of the narrowest part of the air flow channel of Embodiment A is set to be 0.24 mm or smaller.

According to this embodiment, damage caused on a surface of the coating target is prevented even further.

Embodiment C

Embodiment C is characterized that a spray coating device 1 contains a spray gun 4 according to Embodiment A or B, a rotatably supporting unit configured to support the coating target with rotating, and a moving unit, such as a guide rail 54, configured to move the spray gun along a rotational axis of the rotatably supporting unit.

According to this embodiment, a coating liquid is applied to a coating target through coating, without damaging a surface of the coating target.

Embodiment D

Embodiment D is characterized that a method for producing an electrophotographic photoconductor contains forming a predetermined layer constituting an electrophotographic photoconductor using the spray coating device 1 according to Embodiment C, to produce the electrophotographic photoconductor.

According to this embodiment, an upper layer is applied through coating on a layer of an electrophotographic photoconductor that is formed before the forming without damaging the layer.

Embodiment E

Embodiment E is characterized that, in the method of Embodiment D, the predetermined layer is a surface protective layer constituting the electrophotographic photoconductor, and the forming is forming the surface protective layer on a photoconductive layer constituting the electrophotographic photoconductor, to produce the electrophotographic photoconductor.

According to this embodiment, a surface protective layer is applied through coating on a photoconductive layer of an electrophotographic photoconductor that, is formed before the forming without damaging the photoconductive layer.

This application claims priority to Japanese application No. 2013-191290, filed on Sep. 17, 2013 and incorporated herein by reference.

What is claimed is:

1. A spray gun, comprising:

a coating liquid nozzle configured to discharge a coating liquid, which is supplied from a coating liquid supplying unit, from an outlet; and a flow channel forming member configured to surround an outer perimeter surface of the coating liquid nozzle to form an air flow channel, through which atomizing air supplied from an atomizing air supply unit passes, between the outer perimeter surface of the coating liquid nozzle and the flow channel forming member, wherein the air flow channel formed by the flow channel forming member surrounding the coating liquid nozzle, in a direction towards an outlet end of the coating liquid nozzle, becomes gradually narrower until a narrowest part of the air flow channel and then, in the direction from the narrowest towards the outlet end, expands until the airflow channel reaches an end thereof corresponding to the outlet end, wherein the spray gun is configured to atomize the coating liquid supplied from the outlet of the coating liquid nozzle with the atomizing air supplied from the air flow channel to spray the atomized coating liquid to a coating target, wherein a gap T of the narrowest part of the air flow channel is 0.48 mm or smaller, and wherein a ratio T/L of the gap T of the narrowest part of the air flow channel to a distance L from the narrowest part to an apical surface at which the outlet of the coating liquid nozzle is open is 0.60 or greater.

2. The spray gun according to claim 1, wherein the gap T of the narrowest part of the air flow channel is 0.24 mm or smaller.

3. A spray coating device, comprising:

the spray gun according to claim 1;

a rotatably supporting unit configured to support the coating target with rotating; and a moving unit configured to move the spray gun along a rotational axis of the rotatably supporting unit.

4. A spray gun, comprising:

a coating liquid nozzle configured to discharge a coating liquid, which is supplied from a coating liquid supplying unit, from an outlet; and a flow channel forming member configured to surround an outer perimeter surface of the coating liquid nozzle to form an air flow channel, through which atomizing air supplied from an atomizing air supply unit passes, between the outer perimeter surface of the coating liquid nozzle and the flow channel forming member, wherein the spray gun is configured to atomize the coating liquid supplied from the outlet of the coating liquid nozzle with the atomizing air supplied from the air flow channel to spray the atomized coating liquid to a coating target, wherein a gap T of the narrowest part of the air flow channel is 0.48 mm or smaller, wherein a ratio T/L of the gap T of the narrowest part of the air flow channel to a distance L from the narrowest part to an apical surface at which the outlet of the coating liquid nozzle is open is 0.60 or greater, and wherein an angle $\theta 1$ formed between an outer perimeter surface of the outlet of the coating liquid nozzle and a central axis of the spray gun, and an angle $\theta 2$ formed between the central axis O and an inner wall surface of the flow channel forming member from the narrowest part of the air flow channel to an outlet end thereof, satisfy the following conditions: $\theta 1 \geq \theta 2$, $\theta 1 \geq 0°$, and $\theta 2 \geq 0°$.

* * * * *